US011016411B2

(12) United States Patent
Matsumaru et al.

(10) Patent No.: US 11,016,411 B2
(45) Date of Patent: May 25, 2021

(54) PROCESS CARTRIDGE, DEVELOPING APPARATUS, AND IMAGE FORMING APPARATUS

(71) Applicant: CANON KABUSHIKI KAISHA, Tokyo (JP)

(72) Inventors: Naoki Matsumaru, Sunto-gun (JP); Joji Goto, Susono (JP); Takatoshi Hamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/019,027

(22) Filed: Sep. 11, 2020

(65) Prior Publication Data

US 2021/0080859 A1 Mar. 18, 2021

(30) Foreign Application Priority Data

Sep. 17, 2019 (JP) ..... JP2019-168213

(51) Int. Cl.
*G03G 21/16* (2006.01)
*G03G 15/08* (2006.01)
*G03G 21/18* (2006.01)

(52) U.S. Cl.
CPC ..... *G03G 15/0817* (2013.01); *G03G 21/1814* (2013.01); *G03G 21/1821* (2013.01); *G03G 21/1825* (2013.01); *G03G 21/1853* (2013.01)

(58) Field of Classification Search
CPC ..... G03G 15/0817; G03G 15/0884; G03G 15/0886; G03G 21/1814; G03G 21/1821; G03G 21/1825
See application file for complete search history.

(56) References Cited

U.S. PATENT DOCUMENTS 8,755,713 B2 * 6/2014 Kawai ..... G03G 21/181 399/109
9,285,765 B2 * 3/2016 Anan ..... G03G 15/0886

FOREIGN PATENT DOCUMENTS

| | | | |
|---|---|---|---|
| JP | 2007025250 | A | 2/2007 |
| JP | 2007178806 | A | 7/2007 |
| JP | 2014063071 | A | 4/2014 |
| JP | 2014191325 | A | 10/2014 |
| JP | 2019101165 | A | 6/2019 |

* cited by examiner

*Primary Examiner* — Hoang X Ngo
(74) *Attorney, Agent, or Firm* — Canon U.S.A., Inc. I.P. Division

(57) ABSTRACT

A process cartridge includes a first unit including an image bearing member to bear a developing agent image, a second unit including a development frame member in which a developing agent bearing member to bear a developing agent to be supplied to the image bearing member is supported, and a coupling portion that can couple the first and second units such that the second unit is swingable with the coupling portion as a rotation center. The development frame member includes a replenishing opening for the developing agent, and an elastically-deformable sealing member that seals the supply portion and the replenishing opening. As viewed along a compression direction of the sealing member, in a section orthogonal to a longitudinal direction of the process cartridge, the rotation center is disposed at a position overlapping with the sealing member.

14 Claims, 7 Drawing Sheets

PROCESS CARTRIDGE, DEVELOPING APPARATUS, AND IMAGE FORMING APPARATUS

BACKGROUND

Field of the Disclosure

The present disclosure relates to an image forming apparatus, and a developing apparatus and a process cartridge that are used in the image forming apparatus. In particular; the present disclosure relates to an electrophotographic image forming apparatus using an electrophotographic system, and a developing apparatus and a process cartridge that are used in the electrophotographic image forming apparatus.

Description of the Related Art

In a conventionally known configuration, a developing cartridge (including developing unit), a process cartridge (including developing unit and photosensitive drum), etc. is attachable to and detachable from an apparatus main body of an electrophotographic image forming apparatus.

Japanese Patent Laid-Open No. 2019-101165 discusses a configuration in which a developing unit is swingably attached to a drum unit, and the developing unit is pressed against the drum unit by using a pressing unit to bring the outer peripheral surface of a developing roller into stable contact with the outer peripheral surface of a photosensitive drum.

Japanese Patent Laid-Open No. 2014-191325 discusses a process cartridge that includes a toner receiving opening for replenishment of a developing agent and can be replenished with toner from outside. The process cartridge discussed in Japanese Patent Laid-Open No. 2014-191325 is provided with a sealing member including an elastic member at the toner receiving opening in order to prevent leakage of the toner in replenishment.

The configuration in which the developing unit is pressed against the drum unit by the pressing unit as discussed in Japanese Patent Laid-Open No. 2019-101165 may presumably further adopt a replenishing unit that includes the toner receiving opening and the sealing member for replenishment of the developing agent as discussed in Japanese Patent Laid-Open No. 2014-191325.

In such a case, when the sealing member provided at the receiving opening receives stress, the sealing member may be elastically deformed. The elastic deformation of the sealing member may change contact pressure between the outer peripheral surface of the developing roller and the outer peripheral surface of the photosensitive drum. This may make the contact state between the photosensitive drum and the developing roller unstable.

Thus, it is desired to provide a process cartridge, a developing apparatus, and an image forming apparatus that each enable replenishment of a developing agent and improve stability of a contact state between an image bearing member and a developing agent bearing member.

SUMMARY

According to an aspect of the present disclosure, a process cartridge includes a first unit including an image bearing member that can bear a developing agent image and a second unit including a development frame member in which a developing agent bearing member is supported. The developing agent bearing member can bear a developing agent to be supplied to the image bearing member. The process cartridge additionally includes a coupling portion that can couple the first unit and the second unit such that the second unit is swingable with respect to the first unit, with the coupling portion as a rotation center. Wherein the development frame member includes a replenishing opening through which the developing agent is replenished from a supply portion of an image forming apparatus in a state where the replenishing opening is connected to the supply portion, and an elastically-deformable sealing member that is attached to the replenishing opening and seals the supply portion and the replenishing opening to prevent leakage of the developing agent. Wherein, as viewed along a compression direction of the sealing member that is compressed, between the supply portion and the replenishing opening, with a pressing force connecting the replenishing opening to the supply portion, in a section orthogonal to a longitudinal direction of the process cartridge, the rotation center is disposed at a position overlapping with the sealing member.

According to another aspect, a developing apparatus includes a developing agent bearing member that can bear a developing agent and a development frame member in which the developing agent bearing member is supported. The developing apparatus is swingable with respect to a unit including an image bearing member when the developing apparatus is coupled with the unit. Wherein the development frame member includes a replenishing opening through which the developing agent is replenished from a supply portion of an image forming apparatus in a state where the replenishing opening is connected to the supply portion, and an elastically-deformable sealing member that is attached to the replenishing opening and seals the supply portion and the replenishing opening to prevent leakage of the developing agent. And, as viewed along a compression direction of the sealing member that is compressed between the supply portion and the replenishing opening with a pressing force connecting the replenishing opening to the supply portion, in a cross-section orthogonal to a longitudinal direction of the developing apparatus, a rotation center of the swing with respect to the unit is disposed at a position overlapping with the sealing member.

According to another aspect of the disclosure, an image forming apparatus includes the process cartridge or the developing apparatus, and the supply portion.

Further features of the present disclosure will become apparent from the following description of exemplary embodiments with reference to the attached drawings.

DESCRIPTION OF THE EMBODIMENTS

An exemplary embodiment of the present disclosure can be implemented in a mode of an electrophotographic image forming apparatus (hereinafter, simply referred to as "image forming apparatus" in some cases), or any of a process cartridge and a developing apparatus configuring a part of the image forming apparatus.

An image forming apparatus according to an exemplary embodiment of the present disclosure will be described below with reference to the accompanying drawings.

Exemplary embodiments described below describe the present disclosure for illustrative purpose, and dimensions, materials, shapes, relative positional relationship, etc. of components described below do not limit the scope of the present disclosure, unless otherwise specified.

Electrophotographic image forming apparatuses form an image on a recording medium by using an electrophotographic image forming system Examples of electrophotographic image forming apparatuses include an electrophotographic copying apparatus, an electrophotographic printer (e.g., laser beam printer and light-emitting diode (LED) printer), a facsimile apparatus, and a word processor.

The developing apparatus used in the image forming apparatus includes at least a developing unit. The developing apparatus may be formed as a cartridge that is attachable to and detachable from a main body of the electrophotographic image forming apparatus. The developing apparatus may include a toner cartridge that is attachable to and detachable from a frame member of the developing apparatus and can replenish toner to the developing apparatus.

The process cartridge configuring a part of the image forming apparatus has a configuration in which a charging unit, and a developing unit or a cleaning unit, and an electrophotographic photosensitive drum are integrated into a cartridge, and the cartridge is attachable to and detachable from the main body of the electrophotographic image forming apparatus. Alternatively, the process cartridge may have a configuration in which at least one of the charging unit, the developing unit, and the cleaning unit is integrated with the electrophotographic photosensitive drum into a cartridge, and the cartridge is attachable to and detachable from the main body of the electrophotographic image forming apparatus. Yet alternatively, the process cartridge may have a configuration in which at least the developing unit is integrated with the electrophotographic photosensitive drum into a cartridge, and the cartridge is attachable to and detachable from the main body of the electrophotographic image forming apparatus. The process cartridge may be used while being fixed to the image forming apparatus.

EXEMPLARY EMBODIMENT

<Entire Configuration of Image Forming Apparatus 100>

First, an entire configuration of an image forming apparatus 100 according to the present exemplary embodiment will be described below with reference to FIG. 2, FIG. 3A, and FIG. 3B.

Figure 2:
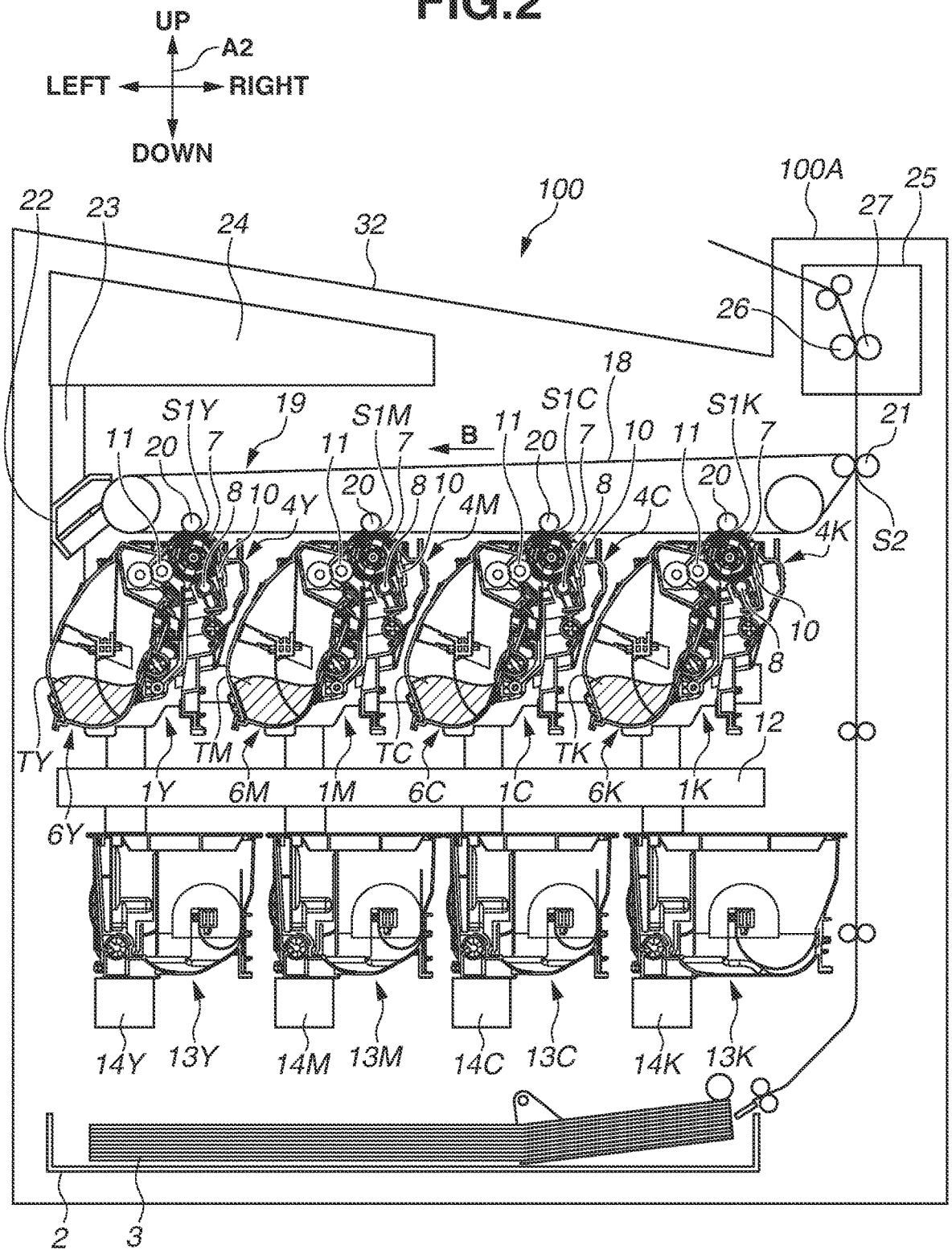
FIG. 2 is a cross-sectional view of the image forming apparatus according to the exemplary embodiment.

In FIG. 2, a section in a vertical direction of the image forming apparatus 100, the process cartridges 1, and the toner cartridges 13 according to the present exemplary embodiment in use is illustrated. In FIG. 3A, a cross-section orthogonal to a longitudinal direction of one process cartridge 1 is illustrated.

In the present exemplary embodiment, the process cartridges 1 and the toner cartridges 13 are flexibly attachable and detachable from the main body of the image forming apparatus 100. An attachment and detachment direction is a direction along the longitudinal direction of each of the process cartridges or the toner cartridges.

In the present exemplary embodiment, configurations and operations of first to fourth image forming units are substantially the same except that the colors of images to be formed are different from one another. Accordingly, in the following description, when there is no need to distinguish the first to fourth image forming units, the first to fourth image forming units are collectively described while subscripts Y to K are omitted.

First to fourth process cartridges 1 are arranged in a horizontal direction. Each of the process cartridges 1 includes a cleaning unit 4 (first unit) and a developing unit 6 (second unit). The cleaning unit 4 includes a photosensitive drum 7 serving as an image bearing member, a charging roller 8 serving as a charging means that uniformly charges the surface of the photosensitive drum 7, and a cleaning blade 10 serving as a cleaning means. The developing unit 6 includes developing means that contains a developing roller 11 (developing agent bearing member) and a developing agent T (hereinafter, toner), and develops an electrostatic latent image on the photosensitive drum 7. The cleaning unit 4 and the developing unit 6 are swingably supported by each other. The first to fourth process cartridges 1 (Y, M, C, and K) each contains yellow (Y), magenta (M), cyan (C), or black (K) toner in the respective developing unit 6.

Each of the process cartridges 1 is attachable to and detachable from the image forming apparatus 100 through an attachment unit provided, such as an attachment guide (not illustrated) and a positioning member (not illustrated), in the image forming apparatus 100. A scanner unit 12 for forming an electrostatic latent image is disposed below the process cartridges 1. A waste toner conveyance unit 23 is disposed on a back side of the process cartridge 1 (downstream side in attachment and detachment direction of process cartridges 1) in the image forming apparatus 100.

First to fourth toner cartridges 13 are arranged in the horizontal direction below the process cartridges 1 in the order corresponding to colors of the toner contained in the respective process cartridges 1. In other words, the first to fourth toner cartridges 13 (Y, M, C, and K) respectively contain yellow (Y) toner, magenta (M) toner, cyan (C) toner, and black (K) toner. Further, each of the toner cartridges 13 replenishes the toner to the process cartridge 1 containing the toner with the same color.

The replenishing operation by each of the toner cartridges 13 is performed when a residual amount detection unit (not illustrated) provided in the main body of the image forming apparatus 100 detects a shortage of a residual amount of the toner in the corresponding process cartridge 1. Each of the toner cartridges 13 is attachable to and detachable from the image forming apparatus 100 through the attachment unit, such as an attachment guide (not illustrated) and a positioning member (not illustrated), provided in the image forming apparatus 100. The process cartridges 1 and the toner cartridges 13 will be described in detail below.

First to fourth toner conveyance devices 14 are arranged below the toner cartridges 13 so as to correspond to the respective toner cartridges 13. The toner conveyance devices 14 upwardly convey the toner received from the respective toner cartridges 13, and supply the toner to the respective developing units 6.

An intermediate transfer unit 19 serving as an intermediate transfer member is provided above the process cartridges 1. The intermediate transfer unit 19 is disposed substantially horizontally with primary transfer portions S1 located at the bottom side. An intermediate transfer belt 18 facing the photosensitive drums 7 is a rotatable endless belt, and is stretched on a plurality of stretching rollers.

On an inner surface of the intermediate transfer belt 18, primary transfer rollers 20 serving as primary transfer members are disposed at positions at which primary transfer portions S1 are formed by the primary transfer rollers 20 and the respective photosensitive drums 7 via the intermediate transfer belt 18. A secondary transfer roller 21 serving as a secondary transfer member, which is in contact with the intermediate transfer belt 18, forms a secondary transfer portion S2 together with a counter oiler via the intermediate transfer belt 18. Further, an intermediate transfer belt cleaning unit 22 is disposed on a side opposite to the secondary transfer portion S2 in a lateral direction in FIG. 1A (direction in which secondary transfer portion S2 and intermediate transfer belt 18 are stretched).

A fixing unit 25 is disposed above the intermediate transfer unit 19. The fixing unit 25 includes a heating unit 26 and a pressurizing roller 27 that comes into pressure contact with the heating unit 26.

A discharge tray 32 is disposed on the top surface of the apparatus main body, and a waste toner recovery container 24 is disposed between the discharge tray 32 and the intermediate transfer unit 19. A sheet feeding tray 2 for containing a recording medium 3 is disposed at a lowermost part of the apparatus main body.

<Image Forming Process>

Next, image forming operation by the image forming apparatus 100 will be described with reference to FIG. 2, FIG. 3A, and FIG. 3B.

Figure 3A:
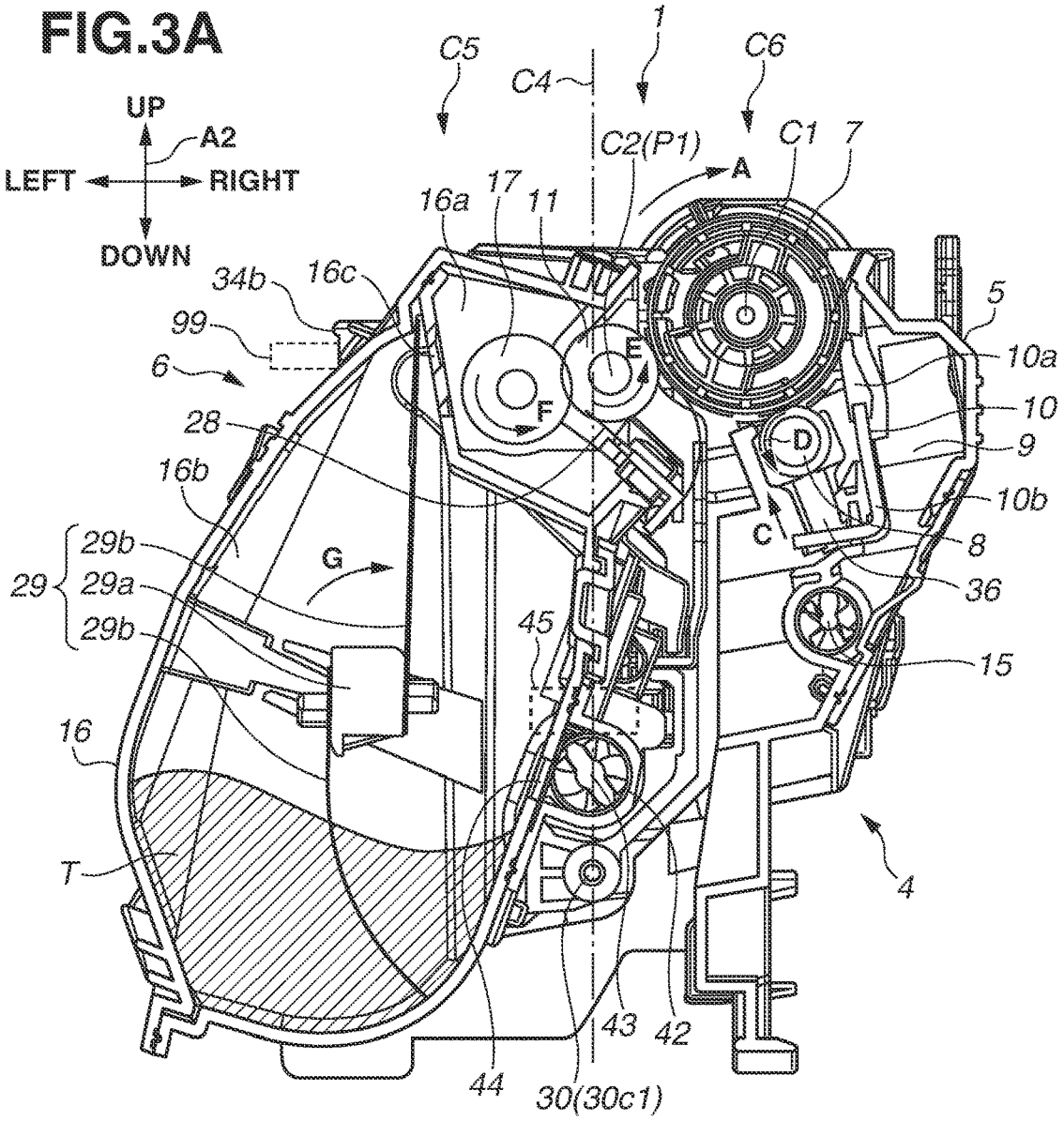
FIG. 3A is a cross-sectional view of the process cartridge according to the exemplary embodiment.

In the image formation, each of the photosensitive drums 7 is rotationally driven in a direction of an arrow A in FIG. 3A at a predetermined speed. The intermediate transfer belt 18 is rotationally driven in a direction of an arrow B (forward direction to rotation of the photosensitive drums 7).

First, surfaces of the photosensitive drums 7 are each uniformly charged by the respective charging rollers 8. Next, the surfaces of the photosensitive drums 7 are scanned and exposed with a laser beam irradiated from the scanner unit 12. Thus, an electrostatic latent image based on image information is formed on each of the photosensitive drums 7.

The electrostatic latent image formed on each photosensitive drums 7 is developed as a toner image by the respective developing units 6. At this time, the developing units 6 are each pressurized by respective developing pressurizing units (not illustrated) provided in the main body of the image forming apparatus 100. Thereafter, the toner images formed on the photosensitive drums 7 are each primarily transferred to the intermediate transfer belt 18 by the respective primary transfer rollers 20.

For example, in full-color image formation, the above-described processes are sequentially performed in the image forming units S1Y to S1K, which are the first to fourth primary transfer portions, and the toner image of the respective colors is sequentially superimposed on the intermediate transfer belt 18.

By contrast, the recording medium 3 in the sheet feeding tray 2 is fed at a predetermined control timing, and is conveyed to the secondary transfer portion S2 in synchronization with a movement of the intermediate transfer belt 18. The toner images of the four colors on the intermediate transfer belt 18 are collectively secondarily transferred to the recording medium 3 by the secondary transfer roller 21 that is in contact with the intermediate transfer belt 18 through the recording medium 3.

Thereafter, the recording medium 3 on which the toner image has been transferred is conveyed to the fixing unit 25. In the fixing unit 25, the recording medium 3 is heated and pressurized. Thus, the toner image is fixed to the recording medium 3. The recording medium 3 subjected to fixing is conveyed to the discharge tray 32, and the image forming operation is completed.

Primary transfer residual toner (waste toner) remaining on the photosensitive drums 7 after the primary transfer process is removed by the cleaning blades 10. Secondary transfer residual toner (waste toner) remaining on the intermediate transfer belt 18 after the secondary transfer process is removed by the intermediate transfer belt cleaning unit 22.

The waste toner removed by the cleaning blades 10 and the intermediate transfer belt cleaning unit 22 is conveyed by the waste toner conveyance unit 23 provided in the apparatus main body, and is accumulated in the waste toner recovery container 24. It should be noted that the image forming apparatus 100 can also form an image of a single color or multiple colors by using desired one or some (not all) of the image forming units.

<Process Cartridge>

Next, an entire configuration of one process cartridge 1 to be attached to the image forming apparatus 100 according to the present exemplary embodiment will be described with reference to FIG. 4 to FIG. 6.

Figure 4:
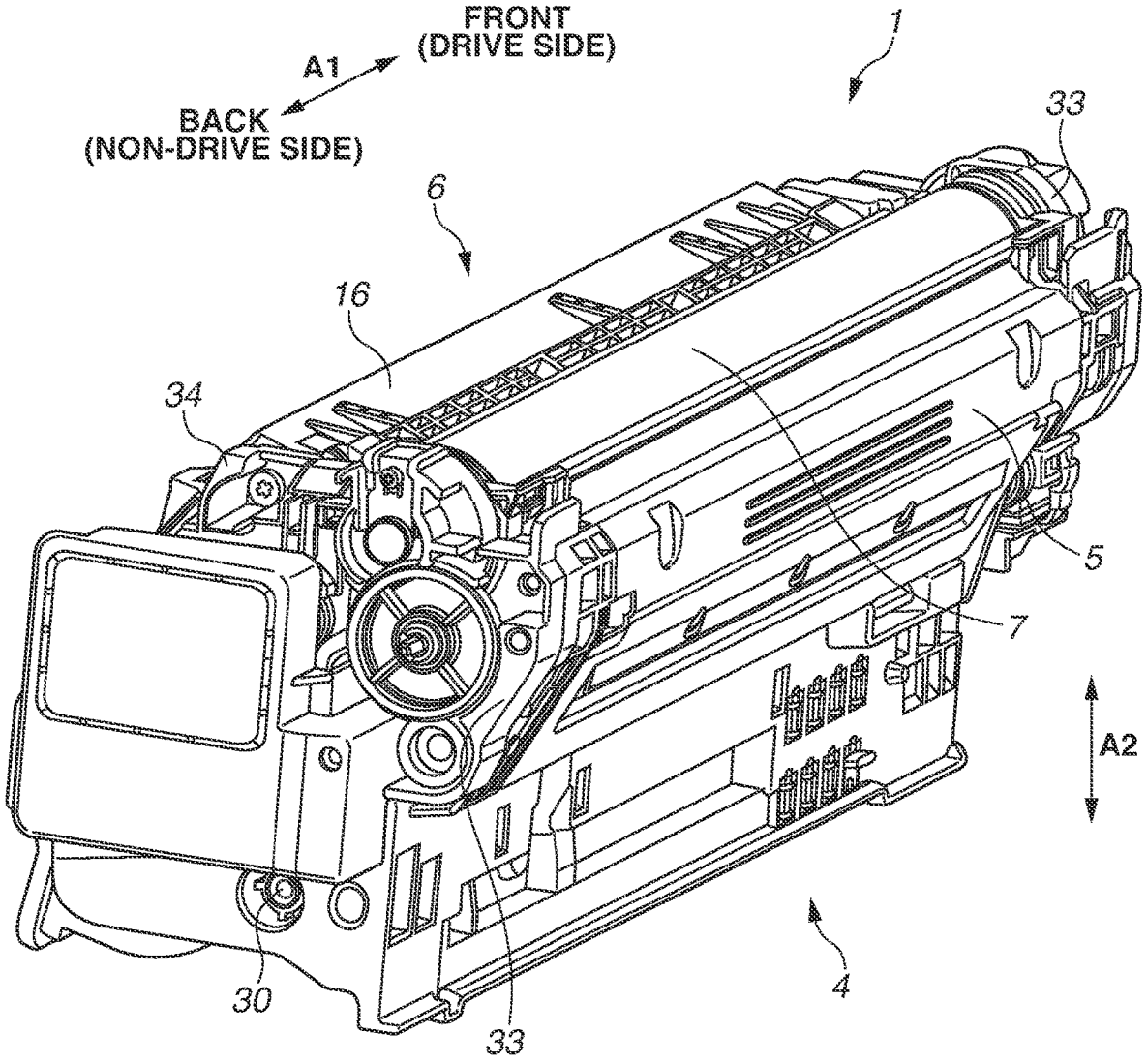
FIG. 4 is a perspective view illustrating a non-drive side of the process cartridge (as viewed from above) according to the exemplary embodiment.

More specifically, FIG. 4 is a perspective view of the process cartridge 1 as viewed from a front side (upstream side in process cartridge attachment direction). FIG. 5 is a perspective view of the process cartridge 1 as viewed from a back side (downstream side in process cartridge attachment direction).

The process cartridge 1 includes the cleaning unit 4 and the developing unit 6. The cleaning unit 4 includes a cleaning frame member 5 that supports various members inside the cleaning unit 4.

The cleaning unit 4 internally includes a waste toner conveyance screw 15 that extends in a direction parallel to a rotation axis direction of the photosensitive drum 7, in addition to the photosensitive drum 7, the charging roller 8, and the cleaning blade 10.

In the cleaning frame member 5, cleaning bearings 33 that rotatably support the photosensitive drum 7 and include a cleaning gear train transmitting a driving force from the photosensitive drum 7 to the waste toner conveyance screw 15 are each disposed at respective longitudinal ends of the cleaning unit 4.

The charging roller 8 provided in the cleaning unit 4 is urged toward the photosensitive drum 7 in the direction of an arrow C by a charging roller pressurizing spring (not illustrated). The charging roller 8 is provided to follow the photosensitive drum 7. When the photosensitive drum 7 is rotationally driven in the direction of the arrow A in the image formation, the charging roller 8 is rotated in the direction of an arrow D (forward direction to rotation of photosensitive drum 7).

The cleaning blade 10 provided in the cleaning unit 4 includes an elastic member 10*a* and a supporting member 10*b*. The elastic member 10*a* removes the transfer residual toner (waste toner) remaining on the surface of the photosensitive drum 7 after the primary transfer. The supporting member 10*b* supports the elastic member 10*a*.

The waste toner removed from the surface of the photosensitive drum 7 by the cleaning blade 10 is contained in a waste toner containing chamber 9 that is formed by the cleaning blade 10 and the cleaning frame member 5. The waste toner contained in the waste toner containing chamber 9 is conveyed toward the back side of the image forming apparatus 100 (to downstream side in attachment and detachment direction of process cartridge 1) by the waste toner conveyance screw 5 installed in the waste toner containing chamber 9. The conveyed waste toner is discharged from a waste toner discharge portion 35, and is passed to the waste toner conveyance unit 23 of the image forming apparatus 100.

The developing unit 6 includes a development frame member 16 that supports various members inside the developing unit 6. The development frame member 16 includes a developing chamber 16*a* and a toner containing chamber 16*b* (developing agent containing chamber). The developing chamber 16*a* is provided therein with the developing roller 11 and the supply roller 17. The toner containing chamber 16*b* contains the toner and is provided therein with a stirring member 29.

The developing chamber 16*a* is provided with the developing roller 11, the supply roller 17, and a developing blade 28. The developing roller 11 bears the toner. In the image formation, the developing roller 11 is rotated in a direction of an arrow E, and comes into contact with the photosensitive drum 7 to convey the toner to the photosensitive drum 7.

The developing roller 11 is rotatably supported to the development frame member 16 by a development bearing unit 34 at both ends of the developing roller 11 in the longitudinal direction (rotation axis direction). The supply roller 17 is rotatably supported to the development frame member 16 by the development bearing unit 34 while being in contact with the developing roller 11. In the image formation, the supply roller 17 is rotated in the direction of an arrow F. Further, the developing blade 28 serving as a layer regulation member that regulates the thickness of a toner layer formed on the developing roller 11 is disposed so as to come into contact with the surface of the developing roller 11.

In the toner containing chamber 16*b*, the stirring member 29 for stirring the contained toner T and conveying the toner to the supply roller 17 via a developing chamber communication opening 16*c* is provided. The stirring member 29 includes a rotary shaft 29*a* and a stirring sheet 29*b*. The rotary shaft 29*a* is parallel to the rotation axis direction of the developing roller 11. The stirring sheet 29*b* serves as a conveyance member that is a flexible sheet. One end of the stirring sheet 29*b* is attached to the rotary shaft 29*a*, and the other end of the stirring sheet 29*b* is a free end. The rotation of the rotary shaft 29*a* rotates the stirring sheet 29*b* in the direction of an arrow G, and thus, the toner is stirred by the stirring sheet 29*b*.

The developing unit 6 includes the developing chamber communication opening 16*c* that makes the developing chamber 16*a* and the toner containing chamber 16*b* communicate with each other. In the present exemplary embodiment, in an attitude (attitude in use) at which the developing unit 6 is normally used, the developing chamber 16*a* is positioned above the toner containing chamber 16*b*. The toner drawn up by the stirring member 29 inside the toner containing chamber 16*b* is supplied to the developing chamber 16*a* through the developing chamber communication opening 16*c*.

Figure 5:
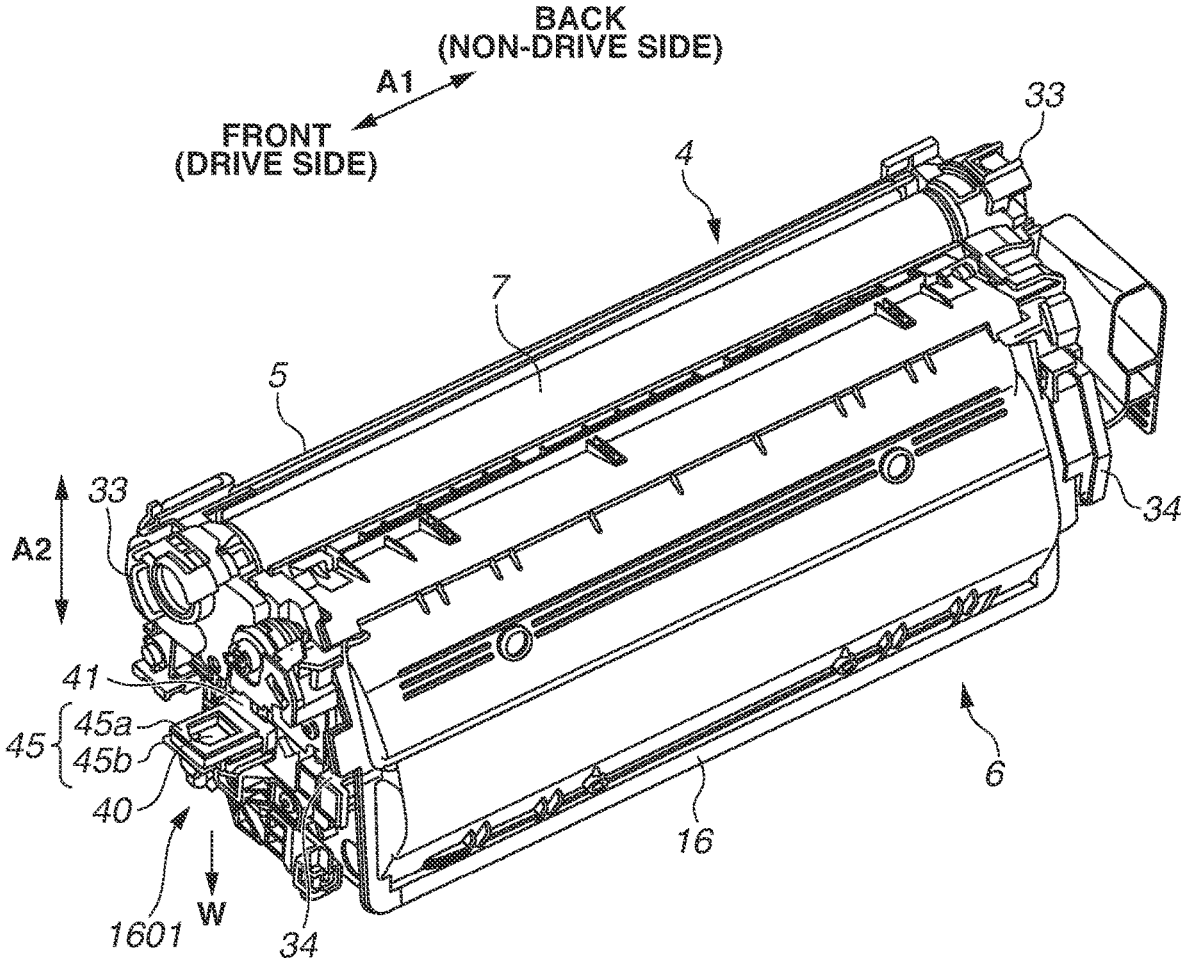
FIG. 5 is a perspective view illustrating a drive side of the process cartridge (as viewed from above) according to the exemplary embodiment.
Figure 6:
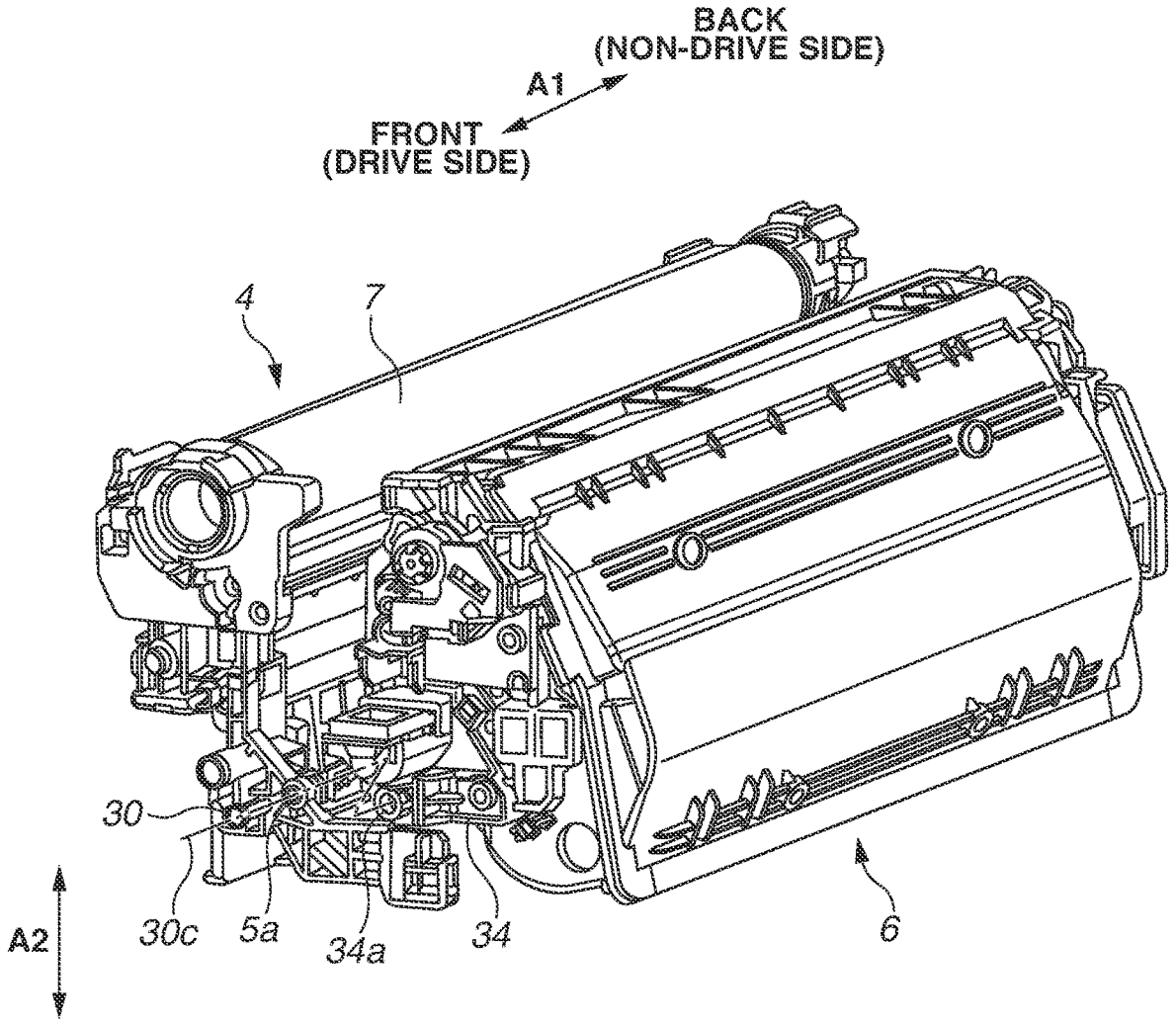
FIG. 6 is a perspective view illustrating the drive side of the process cartridge (as viewed from above) according to the exemplary embodiment, before coupling by a coupling portion.

The developing unit 6 is further provided with a toner receiving opening 40 (replenishing opening) at an end 1601 on one end side in the attachment and detachment direction (i.e., longitudinal direction A1) (FIG. 5). The toner receiving opening 40 is provided to open upward in a vertical direction A2.

A receiving opening sealing member 45 (sealing member) and a toner receiving opening shutter 41 that is movable in the attachment and detachment direction of the process cartridge 1 are provided on the toner receiving opening 40. The receiving opening sealing member 45 includes a fiber member 45*a* made of polyester or the like, and an elastic member 45*b* made of sponge or the like. The receiving opening sealing member 45 is fixed to the toner receiving opening 40 by a fixing means, such as a double-sided tape.

In a case where the process cartridge 1 is not attached to the image forming apparatus 100, the toner receiving opening 40 is closed by the receiving opening shutter 41. The receiving opening shutter 41 is urged by the image forming apparatus 100 and is opened in conjunction with operation for attaching the process cartridge 1.

Upon attachment of the process cartridge 1 to the image forming apparatus 100, the receiving opening sealing member 45 comes into contact with a toner supply opening 141 of the apparatus main body, and is compressed in the direction W (compression direction) in FIG. 5. In other words, the elastic force that is generated by the receiving opening sealing member 45 being compressed with a pressing force F1 from the toner supply opening 141 seals the receiving opening sealing member 45 and the toner supply opening 141, thus preventing the toner from being scattered around the toner receiving opening 40.

The toner discharged from the toner cartridge 13 described below is conveyed inside a toner conveyance path (not illustrated) provided inside the image forming apparatus 100, and is supplied to the process cartridge 1 through the toner receiving opening 40.

As illustrated in FIG. 3A, the developing unit 6 is provided with a reception conveyance path 42 that communicates with the toner receiving opening 40, and a reception conveyance screw 43 is disposed inside the reception conveyance path 42. Further, a containing chamber communication opening 44 that supplies the toner to the toner containing chamber 16*b* is provided near the longitudinal center of the developing unit 6, and makes the reception conveyance path 42 and the toner containing chamber 16*b* communicate with each other. The reception conveyance screw 43 extends in parallel with the rotation axis direction of the developing roller 11 and the supply roller 17, and conveys the toner received from the toner receiving opening 40 to the toner containing chamber 16*b* through the containing chamber communication opening 44.

As described above, the developing unit 6 and the cleaning unit 4 are swingably coupled with each other. More specifically, as illustrated in FIG. 6, holes 34*a* and 5*a* are respectively provided at both longitudinal ends of the development bearing unit 34 and the cleaning frame member 5, and the developing unit 6 and the cleaning unit 4 are coupled by a rotation supporting pin 30 (coupling portion) (only one side in longitudinal direction is illustrated).

Accordingly, the development bearing unit 34 is swingably supported to the cleaning unit 4 with a center axis 30*c* (hereinafter, referred to as first rotation axis) of the rotation supporting pin 30 as an axis (rotation center 30*c*1).

Figure 3B:
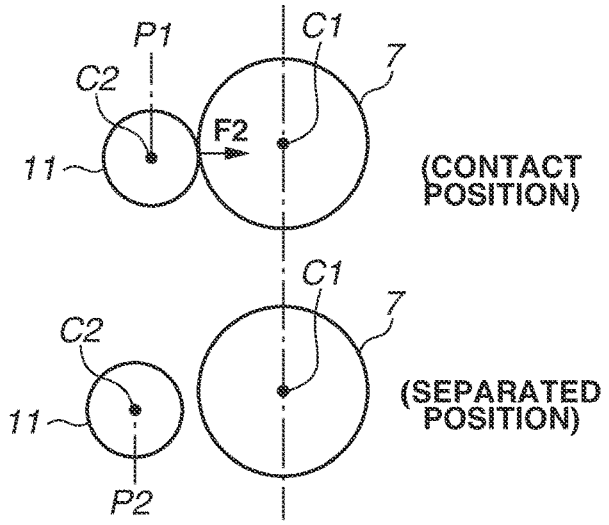
FIG. 3B is a diagram illustrating a contact state (contact position) and a separated state (separated position) between a developing agent bearing member and an image bearing member.

In other words, in the process cartridge 1 according to the present exemplary embodiment, the developing roller 11 is movable to a position (P1) at which the developing roller 11 is in contact with the photosensitive drum 7, and to a position (P2) at which the developing roller 11 is separated from the photosensitive drum 7 as illustrated in FIG. 3B. That is to say, when moving from the contact position P1 (contact state) to the separated position P2 (separated state), the developing roller 11 is moved in a direction in which a center C2 of the developing roller 11 is separated from a center C1 of the photosensitive drum 7.

<Toner Cartridge>

Figure 7:
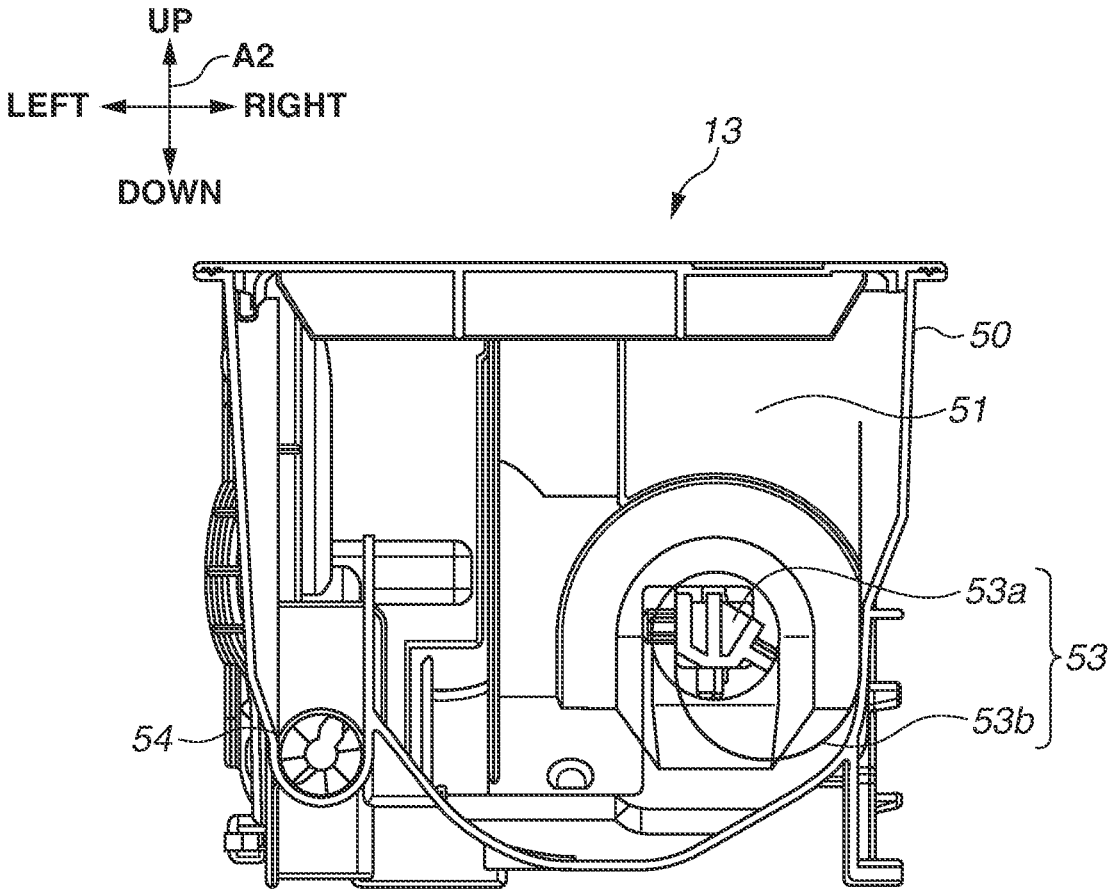
FIG. 7 is a cross-sectional view of a toner cartridge used in the image forming apparatus according to the exemplary embodiment.

Next, one toner cartridge 13 according to the present exemplary embodiment will be described with reference to FIG. 7. FIG. 7 is a sectional view of the toner cartridge used in the image forming apparatus according to the exemplary embodiment.

The toner cartridge 13 includes a replenishment frame member 50 and a replenishment toner containing chamber 51. The replenishment frame member 50 supports various members inside the toner cartridge 13. The replenishment toner containing chamber 51 contains the toner therein. The replenishment toner containing chamber 51 is provided therein with a replenishment toner stirring member 53 and a replenishment toner conveyance screw 54.

The replenishment toner stirring member 53 is disposed in parallel to the longitudinal direction of the toner cartridge 13, and is rotatably supported to the replenishment frame member 50. The replenishment toner stirring member 53 includes a rotary shaft portion 53*a* and a replenishment stirring conveyance sheet 53*b* including a flexible sheet. The rotation of the rotary shaft portion 53*a* rotates the replenishment stirring conveyance sheet 53*b*, and thus, the toner is conveyed to the replenishment toner conveyance screw 54.

The replenishment toner conveyance screw 54 is disposed in parallel to the rotation axis of the replenishment toner stirring member 53, and is rotatably supported to the replenishment frame member 50. The replenishment toner conveyance screw 54 is rotated to convey the toner inside the replenishment toner containing chamber 51 from the front side to the back side (upstream side to downstream side in the toner cartridge attachment and detachment direction). The conveyed toner is discharged from the toner discharge opening provided on the downstream side of the replenishment toner conveyance screw 54, into the toner conveyance path inside the image forming apparatus 100. As described above, the toner discharged into the toner conveyance path inside the image forming apparatus 100 is replenished into the developing unit 6 through the toner receiving opening 40 illustrated in FIG. 5.

<Positional Relationship Between Receiving Opening Sealing Member and First Rotation Axis>

Next, positional relationship between the receiving opening sealing member 45 and the first rotation axis 30*c* will be described with reference to FIGS. 1A to 1C.

As described above, the process cartridge 1 according to the present exemplary embodiment includes the cleaning unit 4 including the photosensitive drum 7, and the developing unit 6 including the development frame member 16 in which the developing roller 11 is supported.

The cleaning unit 4 and the developing unit 6 are swingably coupled by the rotation supporting pin 30, and the developing unit 6 is configured to be swingable with respect to the cleaning unit 4 with the rotation supporting pin 30 as the rotation center 30*c*1.

Further, the development frame member 16 includes the toner receiving opening 40 that is connectable to the supply portion 141 (see FIG. 1B) of the image forming apparatus 100. The toner receiving opening 40 is provided with the elastically-deformable receiving opening sealing member 45 that seals the supply portion 141 and the toner receiving opening 40 to prevent leakage of the toner.

When the supply portion 141 and the toner receiving opening 40 are connected to each other, the pressing force F1 (see FIG. 1B) is generated in the section (see FIG. 3A) orthogonal to the longitudinal direction A1. As viewed along the compression direction W of the receiving opening sealing member 45 that is compressed with the pressing force F1 between the supply portion 141 and the toner receiving opening 40, the rotation center 30*c*1 is disposed at a position 45S overlapping with the receiving opening sealing member 45.

In the present exemplary embodiment, in a state where the process cartridge 1 is attached to the apparatus main body of the image forming apparatus 100, the receiving opening 40 receives the downward pressing force F1 in the vertical direction (direction W), from the supply portion 141.

More specifically, the developing unit 6 is supported so as to be swingable with respect to the cleaning unit 4 around the rotation supporting pin 30. The development bearing unit 34 is provided with a pressed portion 34*b*. In the image formation, the pressed portion 34*b* is pressed in the direction H in FIG. 1A by a pressing unit 99 provided in the image forming apparatus 100. In FIG. 1A, although only one side of the process cartridge in the longitudinal direction is illustrated, the other side of the process cartridge is similarly configured. Thus, a moment in the direction of an arrow K around the first rotation axis 30*c* acts on the developing unit 6, and the developing roller 11 can come into contact with the photosensitive drum 7 with a certain intrusion amount.

In the present exemplary embodiment, as viewed from the longitudinal direction A1 in the attitude in use, the pressed portion 34*b* is positioned on one side (C5), and the photosensitive drum 7 is positioned on the other side (C6) with respect to a perpendicular (C4) passing through the rotation center (30*c*1).

As described above, when the process cartridge 1 is attached to the image forming apparatus 100, the receiving opening sealing member 45 provided at the toner receiving opening 40 comes into contact with the toner supply opening 141 provided inside the image forming apparatus 100 and is pressed in the direction M illustrated in FIG. 1.

Figure 1A:
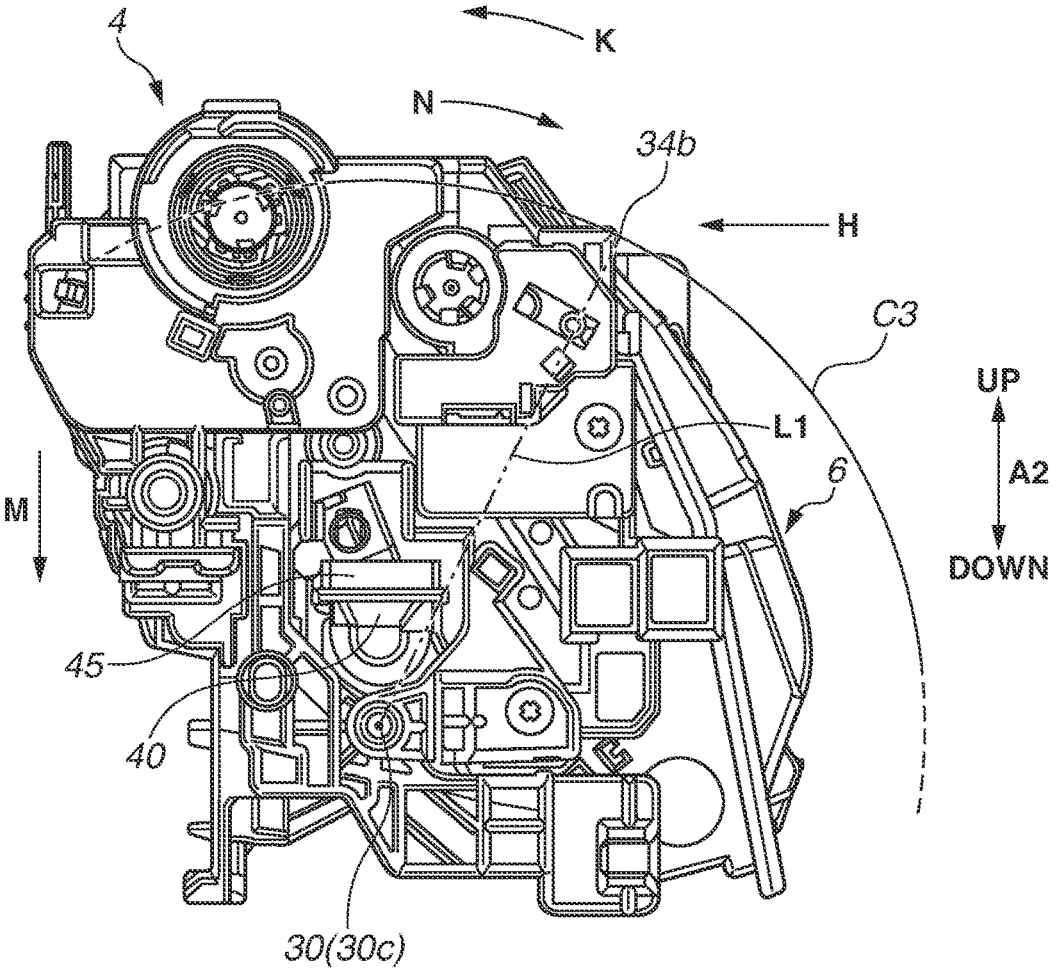
FIG. 1A is a side view of a process cartridge used in an image forming apparatus according to an exemplary embodiment.
Figure 1B:
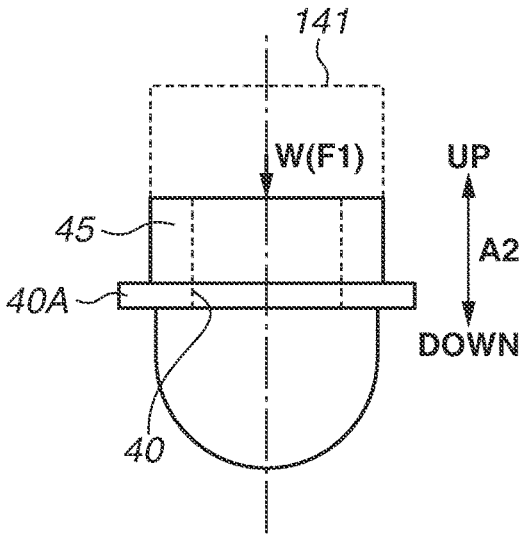
FIG. 1B is an enlarged diagram of a main part near a replenishing opening.
Figure 1C:
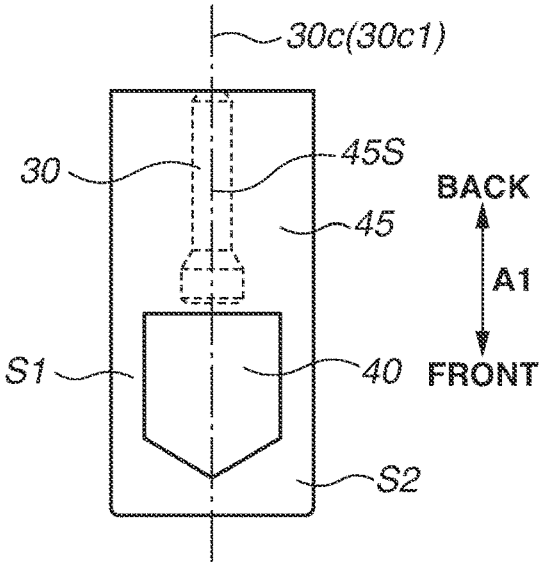
FIG. 1C is a diagram illustrating positional relationship between a sealing member and a coupling portion as viewed along a direction M illustrated in FIG. 1A.

In the present exemplary embodiment, as illustrated in FIG. 1C, the receiving opening sealing member 45 and the rotation supporting pin 30 have such a positional relationship that the first rotation axis 30*c* passes through the area of the receiving opening sealing member 45 as viewed along the compression direction W of the receiving opening sealing member 45. In other words, as viewed along the compression direction W, the sealing member 45 and the rotation center 30*c*1 are disposed at the position 45S at which the sealing member 45 and the rotation center 30*c*1 overlap.

Thus, the moment around the first rotation axis 30*c* produced by the pressing force F1, received by the receiving opening sealing member 45 from the toner supplying opening 141 (supply portion) of the image forming apparatus 100, turns in the opposite direction with the first rotation axis

30*c* in FIG. 1C as a boundary. In other words, in FIG. 1C, the moment in the direction K illustrated in FIG. 1A occurs in an area S1 which is an area on the left side of the first rotation axis 30*c*, and the moment in the direction N illustrated in FIG. 1A occurs in an area S2 which is an area on the right side of the first rotation axis 30*c*. Thus, the moments occurred in the areas S1 and S2 are canceled by each other, which makes it possible to weaken the generated moments around the first rotation axis 30*c*.

In other words, the disposition of the receiving opening sealing member 45 immediately above the first rotation axis 30*c* reduces influence on the pressing force F2 of the developing roller 11 against the photosensitive drum 7, caused by the pressing force F1 received by the receiving opening sealing member 45.

This also applies to a case where the elastic force or the position of the receiving opening sealing member 45 is changed due to a variation of components. The pressing unit 99 of the main body of the image forming apparatus 100 can stably press the developing roller 11 against the photosensitive drum 7.

Even in a case where the toner intervenes the receiving opening sealing member 45 and the elastic force of the receiving opening sealing member 45 changes while the process cartridge 1 is used, it is possible to stably press the developing roller 11 against the photosensitive drum 7.

In the present exemplary embodiment, the toner receiving opening 40 and the receiving opening sealing member 45 are provided in a circular area (C3) that has a radius L1 (rotation radius) about the first rotation axis 30*c* (FIG. 1A). As illustrated in FIG. 1A, the radius L1 is a distance between the first rotation axis 30*c* and the pressed portion 34*b* projected on a plane orthogonal to the first rotation axis 30*c*.

In the present exemplary embodiment, the receiving opening sealing member 45 is disposed at a position close to the first rotation axis 30*c* as compared with the pressed portion 34*b* that receives the pressing force from the main body of the image forming apparatus 100. This makes it possible to reduce the influence on the pressing force of the developing roller 11 against the photosensitive drum 7, caused by the pressing force that the receiving opening sealing member 45 receives.

As described above, even in the case where the elastic force, the attachment position, etc. of the receiving opening sealing member vary, the process cartridge according to the present exemplary embodiment can stably press the developing roller 11 against the photosensitive drum 7, which results in an excellent image.

The configuration according to the exemplary embodiment of the present disclosure can be summarized as follows.

[1] A process cartridge (1) according to an exemplary embodiment of the present disclosure includes a first unit (4) including an image bearing member (7) configured to bear a developing agent image, a second unit (6) including a development frame member (16) in which a developing agent bearing member (11) is supported, the developing agent bearing member (11) being configured to bear a developing agent to be supplied to the image bearing member (7), and a coupling portion (30) configured to couple the first unit (4) and the second unit (6) such that the second unit (6) is swingable with respect to the first unit (4) with the coupling portion as a rotation center (30*c*1).

The development frame member (16) includes a replenishing opening (40) through which the developing agent is replenished from a supply portion (141) of an image forming apparatus (100) in a state where the replenishing opening is connected to the supply portion (141), and an elastically-deformable sealing member (45) that is attached to the replenishing opening (40) and seals the supply portion (141) and the replenishing opening to prevent leakage of the developing agent.

As viewed along a compression direction (W) of the sealing member (45) that is compressed between the supply portion and the replenishing opening with a pressing force (F1) which generates when the replenishing opening (40) is connected to the supply portion (141), in a cross-section orthogonal to a longitudinal direction (A1) of the process cartridge, the rotation center (30*d*) is disposed at a position (45S) overlapping with the sealing member (45).

This enables replenishment of the developing agent and can improve stability of the contact state between the image bearing member and the developing agent bearing member.

[2] In the process cartridge according to an exemplary embodiment of the present disclosure, in an attitude in use, the replenishing opening (40) may be provided to open upward in a vertical direction (A2), and the coupling portion (30) may be positioned below the replenishing opening (40) in the vertical direction (A2).

[3] In the process cartridge according to an exemplary embodiment of the present disclosure, the developing agent bearing member (11) may be movable to a first position (P1) at which the developing agent bearing member (11) is in contact with the image bearing member (7), and to a second position (P2) at which the developing agent bearing member (11) is separated from the image bearing member (7), and the development frame member (16) may include a pressed portion (34*b*) that is pressed by a main body (100A) of the image forming apparatus so as to move the developing agent bearing member (11) from the second position (P2) to the first position (P1).

In the attitude in use, the pressed portion (34*b*) may be located above the replenishing opening (40) in the vertical direction (A2).

[4] In the process cartridge according to an exemplary embodiment of the present disclosure, the replenishing opening (40) and the sealing member (45) may be positioned inside a circular area (C3) that has a center at the rotation center (30*c*1) and has a distance from the rotation center to the pressed portion (34*b*) as a rotation radius (L1).

[5] In the process cartridge according to an exemplary embodiment of the present disclosure, as viewed from the longitudinal direction (A1) in the attitude in use, the pressed portion (34*b*) and the image bearing member (7) may be positioned on different sides (C5 and C6) with a perpendicular line (C4) passing through the rotation center (30*c*1) as a reference.

[6] In the process cartridge according to an exemplary embodiment of the present disclosure, the development frame member (16) may include a developing chamber (16*a*) containing the developing agent bearing member (11), and a developing agent containing chamber (16*b*) that is positioned below the developing chamber in the attitude in use and contains the developing agent, and the replenishing opening (40) may be provided in the development frame member (16) so as to communicate with the developing agent containing chamber (16*b*).

[7] In the process cartridge according to an exemplary embodiment of the present disclosure, as viewed from the longitudinal direction (A1) in the attitude in use, the coupling portion (30) may be disposed immediately below the replenishing opening (40).

[8] In the process cartridge according to an exemplary embodiment of the present disclosure, the replenishing opening (40) may be provided at one end (1601) of the development frame member (16) in the longitudinal direction (A1).

[9] In the process cartridge according to an exemplary embodiment of the present disclosure, the developing agent may be a non-magnetic developing agent of a single component.

[10] In the process cartridge according to an exemplary embodiment of the present disclosure, the process cartridge may be attachable to and detachable from the main body (100A) of the image forming apparatus (100).

[11] A developing apparatus (6) according to an exemplary embodiment of the present disclosure includes a developing agent bearing member (11) configured to bear a developing agent, and a development frame member (16) in which the developing agent bearing member (11) is supported. The developing apparatus (6) is swingable with respect to a unit (4) including an image bearing member (7) when the developing apparatus is coupled with the unit (4).

The development frame member (16) includes a replenishing opening (40) through which the developing agent is replenished from a supply portion (141) of an image forming apparatus (100) in a state where the replenishing opening is connected to the supply portion (141), and an elastically-deformable sealing member (45) that is attached to the replenishing opening (40) and seals the supply portion (141) and the replenishing opening (40) to prevent leakage of the developing agent.

As viewed along a compression direction (W) of the sealing member (45) that is compressed between the supply portion and the replenishing opening with a pressing force (F1) connecting the replenishing opening (40) to the supply portion (141), in a cross-section orthogonal to a longitudinal direction (A1) of the developing apparatus, a rotation center (30*c*1) of the swing with respect to the unit (4) is disposed at a position overlapping with the sealing member (45).

[12] In the developing apparatus according to an exemplary embodiment of the present disclosure, the developing apparatus (6) and the unit (4) may be each attachable to and detachable from a main body (100A) of the image forming apparatus (100).

[13] An image forming apparatus (100) according to an exemplary embodiment of the present disclosure includes the above-described process cartridge (1) or the above-described developing apparatus (6), and the supply portion (141).

According to exemplary embodiments of the present disclosure, it is possible to replenish the developing agent, and to improve stability of the contact state between the image bearing member and the developing agent bearing member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-168213, filed on Sep. 17, 2019 which is hereby incorporated by reference herein in its entirety.

What is claimed is:

1. A process cartridge, comprising:

a first unit including an image bearing member configured to bear a developing agent image;

a second unit including a development frame member in which a developing agent bearing member is supported, the developing agent bearing member being configured to bear a developing agent to be supplied to the image bearing member; and a coupling portion configured to couple the first unit and the second unit such that the second unit is swingable with respect to the first unit with the coupling portion as a rotation center, wherein the development frame member includes a replenishing opening through which the developing agent is replenished from a supply portion of an image forming apparatus in a state where the replenishing opening is connected to the supply portion, and an elastically-deformable sealing member that is attached to the replenishing opening and seals the supply portion and the replenishing opening to prevent leakage of the developing agent, and wherein, as viewed along a compression direction of the sealing member that is compressed between the supply portion and the replenishing opening with a pressing force connecting the replenishing opening to the supply portion, in a cross-section orthogonal to a longitudinal direction of the process cartridge, the rotation center is disposed at a position overlapping with the sealing member.

2. The process cartridge according to claim 1, wherein, in an attitude in use, the replenishing opening is provided to open upward in a vertical direction, and wherein the coupling portion is positioned below the replenishing opening in the vertical direction.

3. The process cartridge according to claim 1, wherein the developing agent bearing member is configured to be movable to a first position at which the developing agent bearing member is in contact with the image bearing member, and to a second position at which the developing agent bearing member is separated from the image bearing member, wherein the development frame member includes a pressed portion that is pressed by a main body of the image forming apparatus so as to move the developing agent bearing member from the second position to the first position, and wherein, in an attitude in use, the pressed portion is positioned above the replenishing opening in a vertical direction.

4. The process cartridge according to claim 3, wherein the replenishing opening and the sealing member are positioned inside a circular area that has a center at the rotation center and has a distance from the rotation center to the pressed portion as a rotation radius.

5. The process cartridge according to claim 3, wherein, as viewed from the longitudinal direction in the attitude in use, the pressed portion and the image bearing member are positioned on different sides with respect to a vertical line passing through the rotation center.

6. The process cartridge according to claim 1, wherein the development frame member includes a developing chamber containing the developing agent bearing member, and a developing agent containing chamber that is positioned below the developing chamber in the attitude in use and contains the developing agent, and wherein the replenishing opening is provided in the development frame member so as to communicate with the developing agent containing chamber.

7. The process cartridge according to claim 1, wherein, as viewed from the longitudinal direction in an attitude in use, the coupling portion is disposed immediately below the replenishing opening.

8. The process cartridge according to claim 1, wherein the replenishing opening is provided at one end of the development frame member in the longitudinal direction.

9. The process cartridge according to claim 1, wherein the developing agent is a non-magnetic developing agent of a single component.

10. The process cartridge according to claim 1, wherein the process cartridge is attachable to and detachable from a main body of the image forming apparatus.

11. A developing apparatus, comprising:

a developing agent bearing member configured to bear a developing agent; and a development frame member in which the developing agent bearing member is supported, wherein the developing apparatus is swingable with respect to a unit including an image bearing member when the developing apparatus is coupled with the unit, wherein the development frame member includes a replenishing opening through which the developing agent is replenished from a supply portion of an image forming apparatus in a state where the replenishing opening is connected to the supply portion, and an elastically-deformable sealing member that is attached to the replenishing opening and seals the supply portion and the replenishing opening to prevent leakage of the developing agent, and wherein, as viewed along a compression direction of the sealing member that is compressed between the supply portion and the replenishing opening with a pressing force connecting the replenishing opening to the supply portion, in a cross-section orthogonal to a longitudinal direction of the developing apparatus, a rotation center of the swing with respect to the unit is disposed at a position overlapping with the sealing member.

12. The developing apparatus according to claim 11, wherein the developing apparatus and the unit are each attachable to and detachable from a main body of the image forming apparatus.

13. An image forming apparatus, comprising:

a process cartridge including, a first unit including an image bearing member configured to bear a developing agent image;

a second unit including a development frame member in which a developing agent bearing member is supported, the developing agent bearing member being configured to bear a developing agent to be supplied to the image bearing member; and a coupling portion configured to couple the first unit and the second unit such that the second unit is swingable with respect to the first unit with the coupling portion as a rotation center, wherein the development frame member includes a replenishing opening through which the developing agent is replenished from a supply portion of an image forming apparatus in a state where the replenishing opening is connected to the supply portion, and an elastically-deformable sealing member that is attached to the replenishing opening and seals the supply portion and the replenishing opening to prevent leakage of the developing agent, and wherein, as viewed along a compression direction of the sealing member that is compressed between the supply portion and the replenishing opening with a pressing force connecting the replenishing opening to the supply portion, in a cross-section orthogonal to a longitudinal direction of the process cartridge, the rotation center is disposed at a position overlapping with the sealing member.

14. An image forming apparatus, comprising:

a developing apparatus, including:

a developing agent bearing member configured to bear a developing agent; and a development frame member in which the developing agent bearing member is supported, wherein the developing apparatus is swingable with respect to a unit including an image bearing member when the developing apparatus is coupled with the unit, wherein the development frame member includes a replenishing opening through which the developing agent is replenished from a supply portion of an image forming apparatus in a state where the replenishing opening is connected to the supply portion, and an elastically-deformable sealing member that is attached to the replenishing opening and seals the supply portion and the replenishing opening to prevent leakage of the developing agent, and wherein, as viewed along a compression direction of the sealing member that is compressed between the supply portion and the replenishing opening with a pressing force connecting the replenishing opening to the supply portion, in a cross-section orthogonal to a longitudinal direction of the developing apparatus, a rotation center of the swing with respect to the unit is disposed at a position overlapping with the sealing member.

* * * * *